US006460697B1

(12) United States Patent
Stevens

(10) Patent No.: US 6,460,697 B1
(45) Date of Patent: Oct. 8, 2002

(54) PORTABLE CARRIER

(76) Inventor: Thomas G. Stevens, 126 S. Wacouta Ave., Prairie du Chien, WI (US) 53821

( * ) Notice: Subject to any disclaimer, the term of this patent is extended or adjusted under 35 U.S.C. 154(b) by 0 days.

(21) Appl. No.: 09/669,326

(22) Filed: Sep. 25, 2000

(51) Int. Cl.[7] ..... B65D 69/00
(52) U.S. Cl. ..... 206/225; 206/233; 206/389
(58) Field of Search ..... 206/223, 225, 206/226, 229, 547, 555, 233, 389, 576; 248/177.1, 185.1; 294/137, 146, 159; 211/66; D3/315; 242/159, 160.1, 170, 588.6; 221/32

(56) References Cited

U.S. PATENT DOCUMENTS

| | | | | | |
|---|---|---|---|---|---|
| 3,830,198 | A | * | 8/1974 | Bboone | 118/506 |
| 3,887,103 | A | | 6/1975 | Spooner | |
| 3,991,878 | A | * | 11/1976 | Serio, Jr. et al. | 242/588.6 |
| 4,280,643 | A | * | 7/1981 | Cordova et al. | 294/141 |
| 4,353,182 | A | | 10/1982 | Junkas et al. | |
| D281,929 | S | | 12/1985 | Strobel et al. | |
| 4,580,695 | A | | 4/1986 | Lum | |
| 4,690,345 | A | | 9/1987 | Cotey | |
| 4,720,021 | A | | 1/1988 | Byrns | |
| 4,917,238 | A | | 4/1990 | Schumacher | |
| D307,843 | S | | 5/1990 | Parshall | |
| 5,035,321 | A | | 7/1991 | Denton | |
| D324,198 | S | | 2/1992 | Sundstrom, Jr. | |
| D326,203 | S | | 5/1992 | Butler | |
| D326,347 | S | | 5/1992 | Ancona et al. | |
| D341,463 | S | | 11/1993 | Booth | |
| 5,314,134 | A | * | 5/1994 | Harris et al. | 242/348 |
| 5,415,279 | A | * | 5/1995 | Tan | 206/216 |
| D364,039 | S | | 11/1995 | Kruger | |
| 5,490,625 | A | | 2/1996 | Myatt | |
| 5,553,701 | A | | 9/1996 | Jarecki et al. | |
| 5,595,303 | A | * | 1/1997 | Weeks et al. | 206/576 |
| D379,730 | S | | 6/1997 | Dickman | |
| 5,826,817 | A | * | 10/1998 | Selby | 242/588.6 |
| 5,839,771 | A | | 11/1998 | DeMars | |
| 6,003,667 | A | * | 12/1999 | Barnett et al. | 206/396 |
| D421,337 | S | | 3/2000 | Stevens | |
| 6,068,118 | A | * | 5/2000 | Calloway | 206/233 |

* cited by examiner

*Primary Examiner*—Mickey Yu
*Assistant Examiner*—Jila M. Mohandesi
(74) *Attorney, Agent, or Firm*—DeWitt Ross & Stevens SC; Charles S. Sara

(57) ABSTRACT

A carrier is provided that includes a rear compartment and a dispensing cradle for dispensing a roll of material. The dispensing cradle has a guide wall having an elongated opening defined therein and through which the rolled material is fed. The dispensing cradle is in front of and connected to the rear compartment. The carrier also has a forward compartment in front of and affixed to the dispensing cradle.

11 Claims, 4 Drawing Sheets

PORTABLE CARRIER

FIELD OF THE INVENTION

The invention relates to portable carriers or organizers for holding and transporting articles.

BACKGROUND OF THE INVENTION

Projects, such as house repair projects, typically require multiple articles for the project. For example, in a painting project, paint brushes, paint cans, a stirrer, a screw driver or other can opener, and tape is oftentimes needed. Also useful in painting and other projects is a roll of paper towels. These articles oftentimes have to be moved from an initial area, such as a storage area, to the work area, such as the room to be painted. In addition, the articles oftentimes have to be moved within the work area. It is therefore desirable to have a carrier or organizer to hold the articles and to transport them.

Most of the conventional carriers do not include a structure that dispenses rolled material such as paper towel. Those carriers that have a dispenser, however, lack a guide that sufficiently holds the rolled material in place while it is dispensed. This deficiency makes it difficult to dispense rolled material.

Other traditional carriers are designed for specific purposes, such as for carrying swimming pool equipment. Still other existing carriers are designed for carrying cleaning supplies. It is difficult to adopt these specific-use carriers to other purposes.

Previous patents describing such carriers include U.S. Pat. No. 3,887,103 to Spooner; U.S. Pat. No. 4,720,021 to Byrns; U.S. Pat. No. 5,839,771 to DeMars; and U.S. Pat. No. 5,035,321 to Denton.

SUMMARY OF THE INVENTION

The invention, which is defined by the claims set out at the end of this disclosure, is intended to solve at least some of the problems noted above. A carrier is provided that includes a rear compartment and a dispensing cradle for dispensing rolled material such as paper towels. The dispensing cradle has a guide wall including an elongated opening defined therein and through which the rolled material is fed. The dispensing cradle is in front of and connected to the rear compartment. The carrier also has a forward compartment in front of and affixed to the dispensing cradle.

Also provided is a carrier for holding articles having a rear compartment and a dispensing cradle for dispensing rolled material, the dispensing cradle having a guide wall having an elongated opening through which the rolled material is fed. The elongated opening of the guide wall is at least a long as the width of the rolled material. The dispensing cradle is located in front of the rear compartment. The carrier also has a forward compartment in front of the dispensing cradle and a handle that is affixed to the rear compartment.

The carrier described herein can be used for virtually any task in which a user desires to organize and/or transport items. The carrier is particularly useful for purposes such as painting. When used in a painting job, the carrier can hold and transport painting equipment and supplies.

The carrier has multiple sub-compartments to organize and store items transported with the carrier. For example, dry paint brushes can be placed in one sub-compartment, whereas wet ones can be kept in another. As another example, tape that is used to protect molding or windows can be placed in another compartment or in the same compartment that the dry paint brushes are in.

Further advantages, features, and objects of the invention will appear more fully from the following detailed description of the preferred embodiment of the invention made in conjunction with the accompanying drawings.

DETAILED DESCRIPTION OF THE INVENTION

Figure 1:
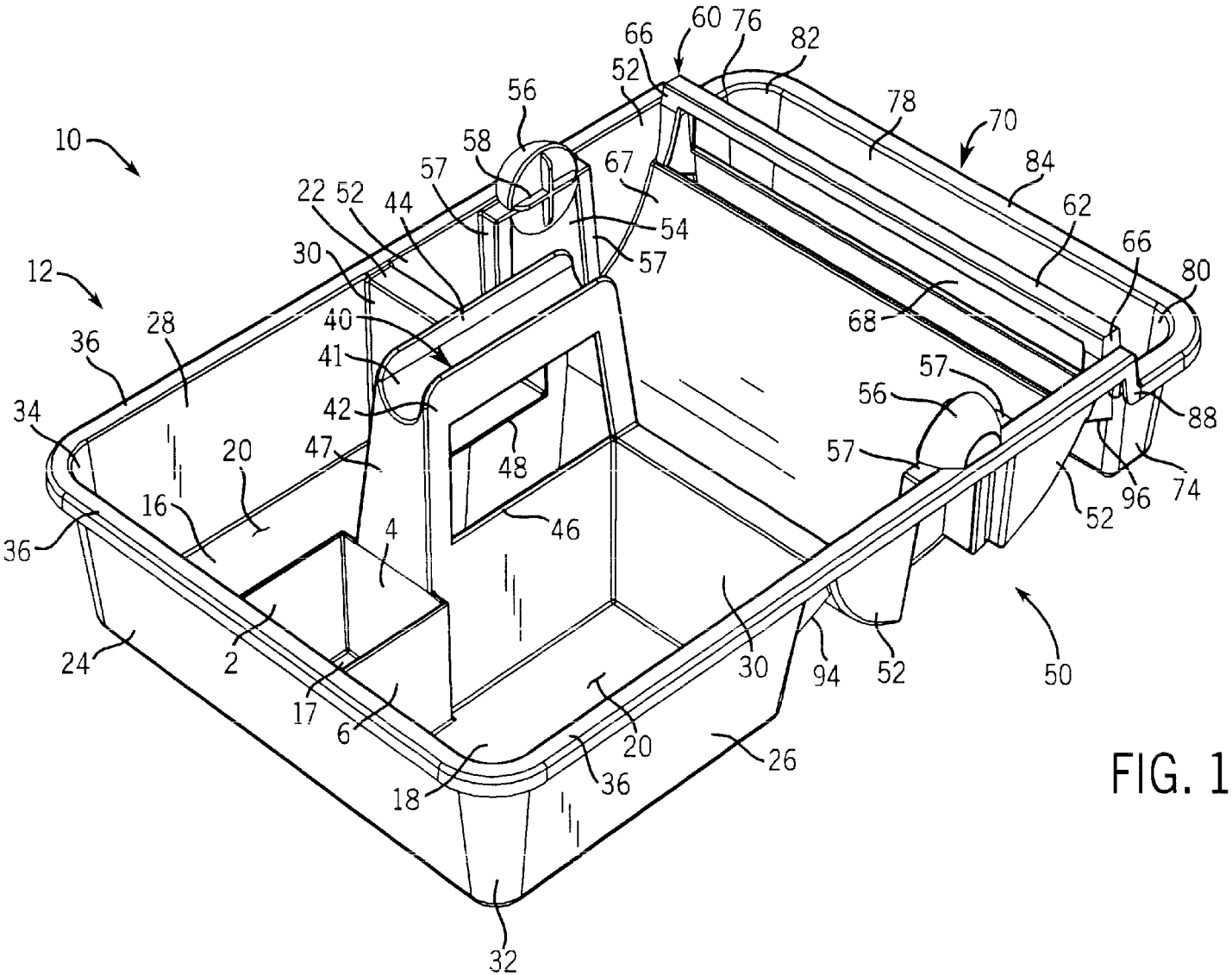
FIG. 1 is a perspective view of a portable carrier made in accordance with a preferred embodiment of the invention.

In the drawings, a first preferred embodiment of the carrier in accordance with the invention is illustrated in FIGS. 1–5 at the reference numeral 10. The carrier 10 is shown in FIG. 1 without rolled material 14, and in FIG. 2, with rolled material.

Figure 2:
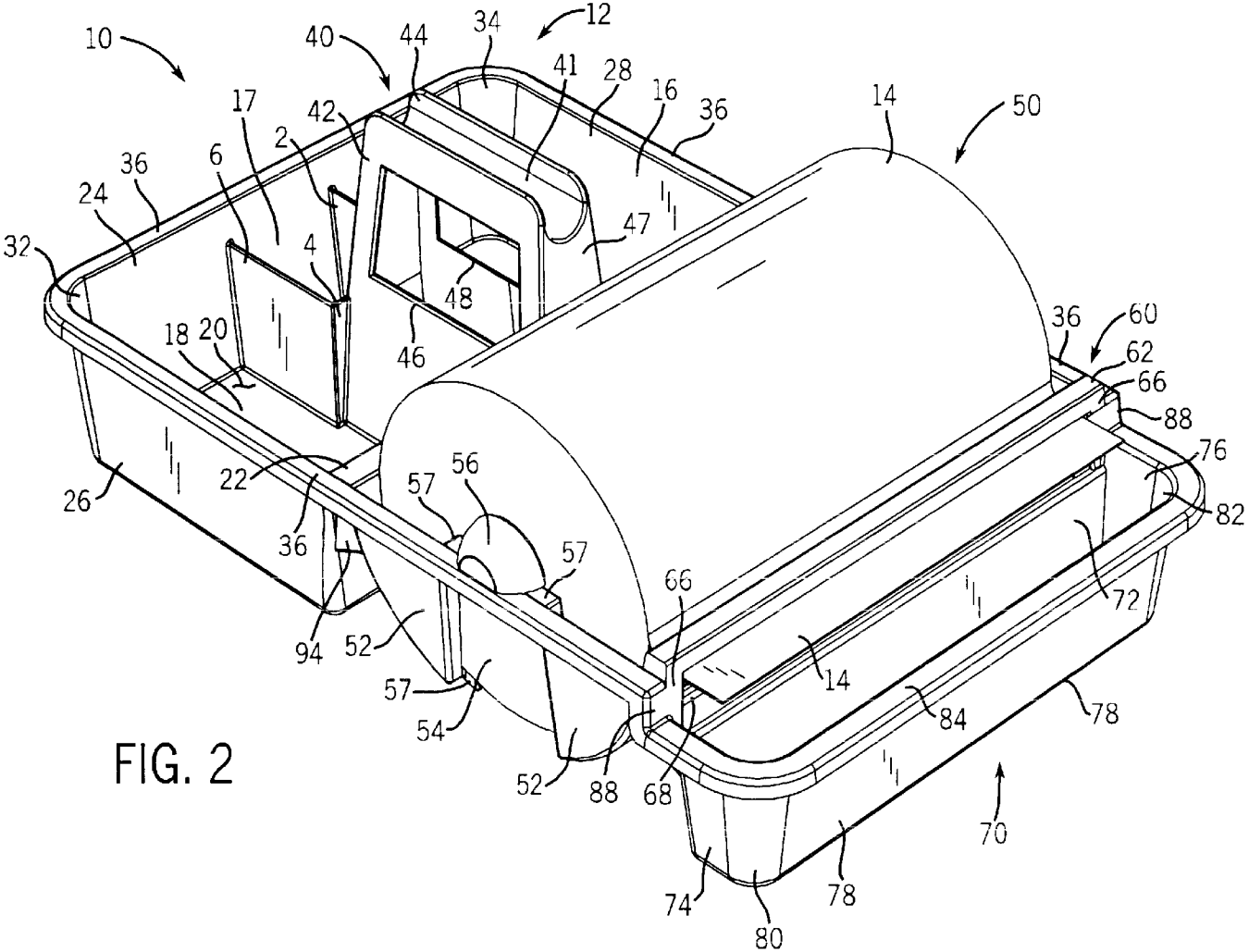
FIG. 2 is a perspective view of the portable carrier of FIG. 1, showing the carrier dispensing rolled material, e.g., paper towels.

The carrier 10 includes a rear compartment 12, a handle 40 centrally located above the rear compartment 12, a dispensing cradle 50 situated in front of the rear compartment 12, a guide wall 60 resting above and forward of the dispensing cradle 50, and a forward compartment 70 in front of the dispensing cradle 50. These parts of the carrier 10 combine to form a generally rectangular shape. As illustrated in FIG. 2, the dispensing cradle 50 may dispense rolled material 14, such as paper towels or shop rags. The guide wall 60 has an elongated opening 68 through which the rolled material 14 is fed. The dispensing cradle 50 is spaced from the rear compartment 12 by a ridge 22 at the top of and that is generally perpendicular to the front compartment 70. A first generally sloped wall 94 also separates dispensing cradle 50 from rear compartment 12. The forward compartment 70 is connected to and is in front of the dispensing cradle 50.

Figure 3:
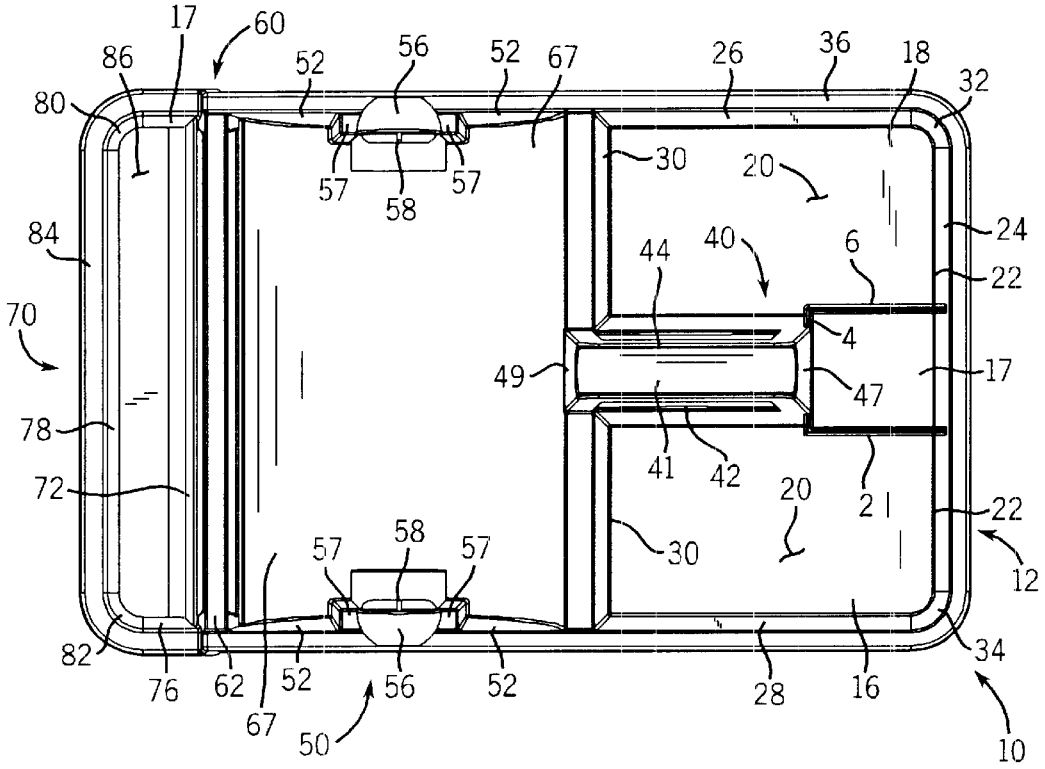
FIG. 3 is a top elevational view of the portable carrier of FIG. 1.

Referring to now to FIG. 3, the rear compartment 12 includes a bottom wall 20, a rear wall 24, a first side wall 26, a second side wall 28, and a front wall 30. Walls 24, 26, 28, and 30 preferably are each generally rectangular in shape and when connected, preferably form a rectangular shape.

Side walls 26 and 28 can be directly connected to the rear wall 24 and front wall 30. However, as is shown in FIGS. 1–2, it is preferred that they are connected via connecting walls 32 and 34, which are preferably curved. The connecting walls 32 and 34 are preferred over having two side walls that connect at a sharp angle, which could damage a work area or injure a user.

The upper edge of the rear wall 24, the first side wall 26, and the second side wall 28 preferably have a downwardly sloping flange 36 on their upper surfaces, extending about at least a portion of the walls 24, 26, and 28. The flange 36 adds structural strength to the walls.

As can be seen most clearly in FIGS. 1 and 2, the handle 40 projects upwardly from the rear compartment 12. The handle 40 is connected to front wall 30 of the rear compartment 12. Preferably, the handle 40 is positioned in the middle of the front wall 30. The handle 40 preferably includes an upper surface 41, a first side 42, and a second side 44. The first and second sides 42, 44 are preferably connected by a rear wall 47 (as shown in FIG. 3), a front wall 49, and upper surface 41 (as are shown in FIG. 2). The first and second sides 42, 44 have openings 46, 48, respectively, therein. The user of the carrier 10 grasps the carrier 10 through openings 46, 48 of the handle 40, thereby engaging upper surface 41 of the handle 40. The handle 40 allows the carrier 10 to be easily balanced in an upward position.

As is best seen in FIGS. 1 and 3, the rear compartment 12 is divided into multiple sub-compartments 16, 17, and 18 by upstanding walls 2, 4, and 6, which are rectangularly shaped. Walls 2, 6 are generally parallel with side walls 26, 28, whereas wall 4 is perpendicular to side walls 26, 28. In combination with rear wall 24, walls 2, 4, and 6 form sub-compartment 17. Wall 2 forms sub-compartment 16, and wall 6 forms sub-compartment 18. The multiple sub-compartments organize and store items transported within carrier 10. For example, dry paint brushes can be placed in one sub-compartment, whereas wet ones can be kept in another. As another example, tape that is used to protect molding or windows can be placed in another compartment or in the same compartment that the dry paint brushes are in.

Referring to FIGS. 1–3, in front of and connected to the rear compartment 12 is the dispensing cradle 50 for holding and dispensing the rolled material 14. The dispensing cradle 50 includes a guide wall 60 with an elongated opening 68 through which the rolled material 14 is fed.

As is shown in FIG. 1, the dispensing cradle 50 includes a curved wall 67 to support a full roll of rolled material 14. On both ends of the curved wall 67 are bridge pieces 52, which are semicircular in shape, one of which is disposed on a bar 57. Between bars 57 is a member 54. At the top of and disposed between the bars 57 and member 54 is an end piece 56 having a protrusion 58, for rotatably receiving the roll of material 14. The dispensing cradle 50 retains the rolled material 14 such that the longitudinal axis of the rolled material 14 is in general parallel alignment with the bottom wall 20 of the rear compartment 12. The benefit of retaining the rolled material 14 in parallel alignment with the bottom wall 20 is that this is a more stable configuration than having the rolled material 14 in perpendicular arrangement with the bottom wall 20.

FIG. 2 illustrates the positioning of the rolled material 14 in the dispensing cradle 50 and its direction through the guide wall 60. Referring back to FIG. 1, the guide wall 60 preferably includes an upper bar 62 and two cross bars 66 that attach the upper bar 62 to the upper ends of curved wall 67 of the dispensing cradle 50 and the upper end of rear wall 72 of forward compartment 70, thereby forming an elongated opening 68 through which the rolled material 14 is fed. The elongated opening 68 directs the rolled material 14 over the forward compartment 70. Preferably, the elongated opening 68 of the guide wall 60 is at least a long as the width of the rolled material 14. This length of the elongated opening 68 stabilizes the path of travel of the rolled material 14. Holding the entire length of the rolled material 14 in place and minimizing movement of the rolled material 14 aids in the tearing of the rolled material 14. Preferably, the rolled material 14 is dispensed by upwardly pulling on the material 14 as it is steadied by the elongated opening 68.

As is illustrated in FIGS. 1–3 and 5, the carrier 10 also has a forward compartment 70 in front of the dispensing cradle 50. Preferably, the forward compartment 70 and dispensing cradle 50 are spaced apart as can be seen in FIG. 1. The forward compartment 70 is generally rectangular in shape and includes a rear wall 72, a first side wall 74, a second side wall 76, and a front wall 78. Walls 72, 74, 76, and 78 preferably are rectangular in shape. Also included is a bottom wall 86 (shown in FIG. 3). The front wall 78 is connected to the first and second side walls 74 and 76 by connecting walls 90 and 92, which are preferably curved. The curved walls are preferred over having two side walls that connect at a sharp angle, which could damage a work area or injure a user. Alternatively, the front wall 78 is directly connected to the first and second side walls 74 and 76.

The upper edge of the front wall 78, side walls 74 and 76, and connecting walls 80 and 82 has a flange 84 on their upper surfaces. The flange 84 extends about at least a portion of the walls. The flange 84 adds structural strength to the walls and connects to the downwardly sloping flanges 88, which connect to flange 36, thereby making a continuous flange about the upper edge of the walls.

The forward compartment 70 can be used to house soiled rolled materials 14 or any other desired item, such as tape that has been used to protect molding or windows from extraneous paint. Carrying items in the forward compartment 70 further weights the carrier 10 such that the carrier 10 is more stable when the rolled material 14 is torn while it is being dispensed.

Figure 4:
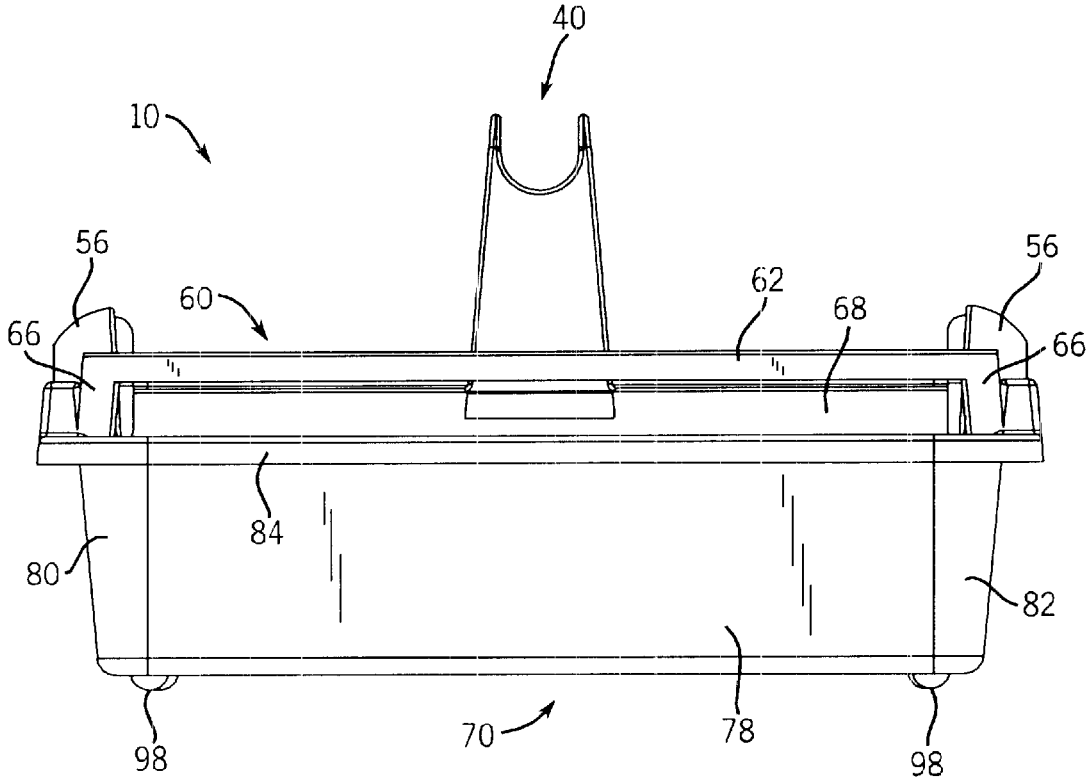
FIG. 4 is a front elevational view of the portable carrier of FIG. 1
Figure 5:
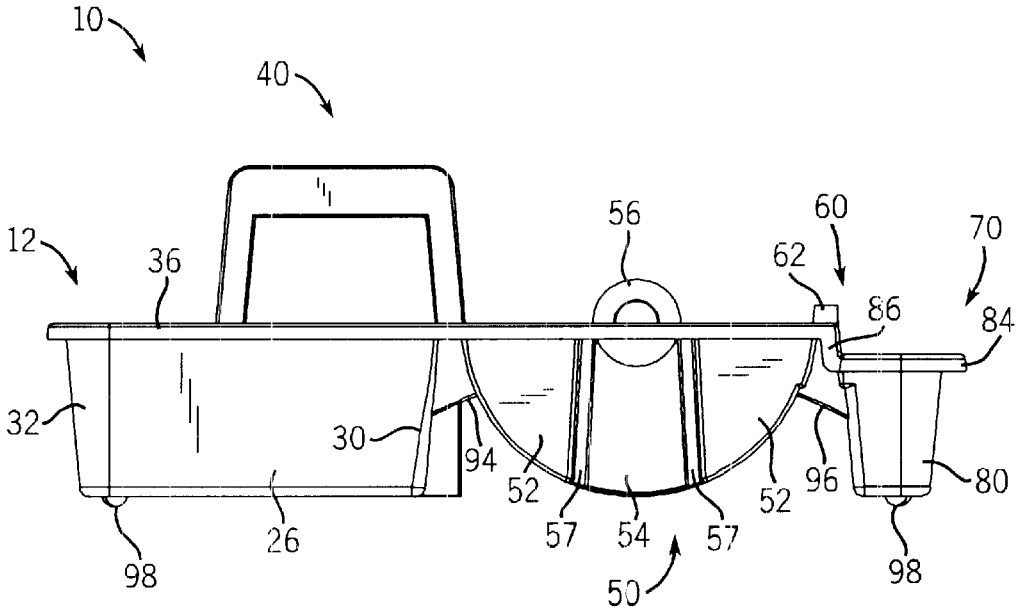
FIG. 5 is a side elevational view of the portable carrier of FIG. 1.

As is illustrated in FIGS. 4 and 5, feet 98 are preferably attached to the underside of the carrier 10. The feet 98 lift the carrier 10 so that there is less contact with the underlying surface if it is dirty or covered with paint. The feet 98 also helps retain the carrier 10 on a ladder shelf by straddling the shelf between the feet 98.

FIG. 5 also demonstrates how the rear compartment 12 is connected to the dispensing cradle 50 via the first generally sloped wall 94 on the underside of the carrier 10. Similarly, the dispensing cradle 50 is connected to the front compartment 70 via a second generally sloped wall 96. The generally sloped walls 94 and 96 add strength to the carrier 10 and keep the rear compartment 12, the dispensing cradle 50, and the front compartment 70 in their respective positions.

The preferred method of fabricating the carrier is to produce it as a single molded piece by rotational molding, injection molding, or the like. Alternatively, some or all of the rear compartment 12, handle 40, dispensing cradle 50, guide wall 60, and front compartment 70 can be made individually and then subsequently connected.

A carrier 10 can be stacked on top of another carrier 10, thereby permitting their efficient storage.

The carrier 10 can be used for virtually any task in which a user desires to organize and/or transport items. The carrier is particularly useful for purposes such as painting. When used in a painting job, the carrier can hold and transport paint brushes, paint, tape, paper towels, and stirrers.

It is understood that the various preferred embodiments are shown and described above to illustrate different possible features of the invention and the varying ways in which these features may be combined. Apart from combining the different features of the above embodiments in varying ways, other modifications are also considered to be within the scope of the invention. Certain preferred options follow.

First, the handle 40 can be of solid construction. The handle 40 could have another shape, such as an arch. The shape of the handle 40 is not crucial.

Second, the number of compartments and sub-compartments can vary in accordance with the tasks for which the carrier 10 is to be used.

Third, the structure of the part of the dispensing cradle 50 that rotatably receives the rolled material 14 can vary. For example, the protrusions 58 need not be cross-members such as those shown in the preferred embodiment.

Fourth, the carrier 10 can optionally include means for attaching. The means for attaching permit the carrier to be attached to another item, such as a ladder, a pole, or a shelf. The means for attaching can have the structure of a clamp, bracket, support, or similar device. The means for attachment permits the user to place the carrier 10 in work areas that do not include an area for setting the carrier.

What is claimed is:

1. A carrier for holding articles comprising:

(a) a rear compartment;

(b) a horizontally-disposed dispensing cradle connected to the rear compartment, the dispensing cradle having a guide wall having an elongated, horizontally-disposed opening defined therein; and (c) a forward compartment, separate from the rear compartment and disposed in front of and affixed to the dispensing cradle.

2. The carrier of claim 1, further comprising a handle affixed to the rear compartment.

3. The carrier of claim 1, wherein the dispensing cradle has an end piece including a protrusion dimensioned and configured for rotatably receiving material on a a roll.

4. The carrier of claim 1, further comprising means for attaching the carrier to another item.

5. A carrier for holding articles comprising:

a. a rear compartment having a recessed interior at least partially surrounded by walls;

b. a front compartment having a recessed interior at least partially surrounded by walls;

c. bridge pieces extending between the front and rear compartments, at least one of the bridge pieces bearing a protrusion extending therefrom and towards the other of the bridge pieces; and d. a guide wall extending upwardly between the front compartment and the bridge pieces, the guide wall having an elongated opening defined therein.

6. The carrier of claim 5, further comprising a curved wall extending between the bridge pieces, the curved wall being spaced from the protrusion so as to define a dispensing cradle.

7. The carrier of claim 6, wherein the curved wall also at least substantially extends between the rear compartment and the front compartment.

8. The carrier of claim 7, wherein the curved wall extends from the rear compartment to conclude at a distance spaced from the front compartment, thereby defining a space situated between the dispensing cradle and the front compartment.

9. The carrier of claim 8, further comprising a guide wall extending upwardly above the front compartment, the guide wall being situated adjacent the space.

10. The carrier of claim 7, wherein:

a. the walls of the rear compartment include a front wall from which the curved wall extends; and b. the carrier includes a handle extending from the front wall.

11. The carrier of claim 10, wherein the handle extends above the interior of the rear compartment.

* * * * *